US005970521A

United States Patent [19]

Rabbeth

[11] Patent Number: 5,970,521

[45] Date of Patent: Oct. 26, 1999

[54] OVERSIZED PROTECTIVE BASKETBALL GRIPPING GLOVE

[76] Inventor: Robert Sydney Rabbeth, 15243 Covello St., Van Nuys, Calif. 91405

[21] Appl. No.: 09/014,412

[22] Filed: Jan. 27, 1998

Related U.S. Application Data

[60] Provisional application No. 60/036,989, Jan. 30, 1997.

[51] Int. Cl.[6] ..... A41D 19/00

[52] U.S. Cl. ..... 2/161.1; 2/16; 2/163; 473/450

[58] Field of Search ..... 2/159, 161.1, 16, 2/161.3, 161.4, 161.8, 20, 163; 473/450

[56] References Cited

U.S. PATENT DOCUMENTS

| | | | |
|---|---|---|---|
| 2,736,034 | 2/1956 | Fredenhagen et al. | 2/159 |
| 3,581,312 | 6/1971 | Nickels | 2/159 |
| 3,640,532 | 2/1972 | Bauer . | |
| 3,707,730 | 1/1973 | Slider . | |
| 4,272,849 | 6/1981 | Thurston et al. | 2/16 |
| 4,411,024 | 10/1983 | Hayes | 2/20 |
| 4,507,807 | 4/1985 | Karkanen | 2/161.8 |
| 4,738,447 | 4/1988 | Brown . | |
| 4,815,147 | 3/1989 | Gazzano et al. . | |
| 4,867,246 | 9/1989 | Kiger | 2/161.8 |
| 4,881,275 | 11/1989 | Cazares et al. | 2/161 |
| 4,930,162 | 6/1990 | Côté . | |
| 5,237,703 | 8/1993 | Brine . | |
| 5,367,711 | 11/1994 | Calagui . | |
| 5,402,537 | 4/1995 | Kolada . | |
| 5,435,013 | 7/1995 | Davis . | |
| 5,453,064 | 9/1995 | Williams, Jr. | 2/161.1 |
| 5,488,739 | 2/1996 | Cardinal . | |
| 5,500,956 | 3/1996 | Schulkin et al. | 2/159 |
| 5,511,247 | 4/1996 | Block . | |
| 5,640,712 | 6/1997 | Hansen et al. | 2/16 |
| 5,774,897 | 7/1998 | Hochmuth | 2/161.1 |

*Primary Examiner*—John J. Calvert
*Assistant Examiner*—Katherine Moran

[57] ABSTRACT

A protective athletic gripping glove is disclosed for enhancing the ability of an individual to facilitate a better grip when holding, shooting, dribbling, passing, catching, or rebounding a basketball. Finger extension portions (32) and thumb extension portion (34) have protective foam padding, palm side (42) has a plurality of friction enhancing elements (80), and wrist portion (44) has a hook and loop fastening element (74). The glove teaches the user the fundamentals of basketball by placing the fingers, thumb, hand, and arm in the proper basketball handling positions. The glove also protects the finger, thumb, and hand from injury. Additionally, the glove exercises and strengthens the muscles of the fingers, thumb, hand, wrist, and forearm.

9 Claims, 3 Drawing Sheets

OVERSIZED PROTECTIVE BASKETBALL GRIPPING GLOVE

CROSS-REFERENCE TO RELATED APPLICATIONS

Disclosure Document #375390, copy enclosed, was filed on May 1, 1995 making reference to the basketball glove of this invention as "The Low Post Claw." In addition, Provisional Patent #60/036,989, copy enclosed, was filed on Jan. 30, 1997 making reference to the basketball glove of this invention as "Oversized Protective Basketball Gripping Glove."

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

The present invention relates to a protective athletic gripping glove, and more particularly to an oversized protective basketball gripping glove having finger extension portions and a thumb extension portion to allow the hand to facilitate a better grip when holding, shooting, dribbling, passing, catching, or rebounding a basketball, and yet protect the hand from injury.

Regulation basketballs having standard measurements and weight specifications are used in professional basketball associations and amateur basketball leagues. The National Basketball Association, Continental Basketball Association and National Collegiate Athletic Association require an official regulation basketball measuring 29½ inches in circumference and weighing 21 ounces to be used in all games. Use of the standard size basketball gives players with large hands an advantage over players with small hands because larger hands cover more surface of the basketball and that creates a tighter grip which provides more accuracy when shooting and passing, and more control when dribbling, catching and rebounding. In addition, a player with large hands can grip or "palm" a basketball with one hand, leaving the other hand free to ward off defenders or establish position under the basket. A player with small hands is at a disadvantage because he or she must use both hands to grip a basketball which eliminates the benefit of a free hand.

Various basketball gloves and hand covering apparatuses are known in the prior art. U.S. Pat. No. 5,500,956 to Schulkin (1996), U.S. Pat. No. 4,738,447 to Brown (1988) and U.S. Pat. No. 3,707,730 to Slider (1973) disclose fingerless gloves which only cover the palm and back of the user's hand. U.S. Pat. No. 4,881,275 to Cazares (1989) discloses a partial hand covering apparatus which is merely five separate finger tip covering cowls attached to elastic bands and anchored by an adjustable wrist band. U.S. Pat. No. 3,640,532 to Bauer (1972) discloses a flexible tube secured to the user's hand by means of an elastic loop and elastic straps. None of the known basketball gloves and apparatuses, however, are concerned with enlarging the user's hand periphery or providing pads to protect the user's hand.

A variety of hockey and lacrosse gloves, represented by U.S. Pat. No. 4,815,147 to Gazzano (1989) and U.S. Pat. No. 4,930,162 to Cote (1990), use pads along the fingers, wrist and back of hand to protect the user while gripping a handled implement such as a hockey stick or lacrosse stick. The bulky pads associated with these gloves restrict freedom of hand movement and offer no assistance to someone attempting to handle a basketball.

Accordingly, there has been a need for a basketball glove which expands the user's hand periphery, improves his or her ability to grip a basketball, and protects the hand from injury. Such a device would enable players with small hands to enjoy the same basketball handling capabilities as players with large hands.

BRIEF SUMMARY OF THE INVENTION

In view of the above-described inadequacies of the related art, several objects and advantages of the present invention are:

(a) to provide a new and improved protective athletic gripping glove construction for use in the game of basketball, or the like;

(b) to provide a glove of the type indicated comprising finger and thumb protective construction which provides flexibility while preserving impact protection of the fingers and thumb throughout the entire normal range of motion thereof;

(c) to provide a glove of the type indicated having protective padding to protect the hand, fingers, and thumb from injury, while including a break line which separates extension portions and backside to allow flexibility of the glove and comfort in gripping a basketball;

(d) to provide a glove of the type indicated which, while affording protection to the fingers and thumb of the user, will permit the user to execute all activities relative to the movement of the hand while handling a basketball;

(e) to provide a glove of the type indicated having finger extension portions and a thumb extension portion incorporated therein to increase the overall size of the glove and expand the user's hand periphery;

(f) to provide a glove of the type indicated having a palm side covered in friction enhancing elements to reduce movement of a basketball once it is gripped;

(g) to provide a glove of the type indicated having flexible finger spacers which extend around the finger stalls of the glove in order to maintain the fingers in a spread apart condition for proper handling of a basketball;

(h) to provide a glove of the type indicated which absorbs sweat from the hand thereby preventing sweat from touching the basketball;

(i) to provide a glove of the type indicated whereby establishment and maintenance of an improved and more secure grip of a basketball is fostered;

(j) to provide a glove of the type indicated which allows for shooting and or dribbling basketballs;

(k) to provide a glove of the type indicated which allows for passing and or catching basketballs;

(l) to provide a new and improved method of teaching the fundamentals of basketball;

(m) to provide a new and improved method of strengthening ones hands and fingers; and (n) to provide a new and improved basketball glove which is comfortable, durable in use, and economical to manufacture.

This invention is directed to an athletic glove for gripping a spherical object such as a basketball. The object of the present invention is to provide a glove which allows a user to easily grip a basketball while simultaneously protecting fingers from injury, strengthening hand muscles and developing fundamental skills for the game of basketball.

The basketball glove has finger extension portions and a thumb extension portion so that user can grip a regulation size basketball tightly, yet in a natural, comfortable position. The basketball glove provides flexible movement while maintaining protection for the user's hand, fingers and thumb. While the glove of this invention has been described in the form of a basketball glove, its features should make it of use for a variety of other sports as well, such as water polo, soccer, football and the like. A glove in accordance with the invention can also be employed for work and other activities.

Although the description above contains many unencumbered specificities, these should not be construed as limiting the scope of the invention but as merely providing illustrations of some of the presently preferred embodiments of the this invention. For example, various sizes of the basketball glove will be necessary in order to properly fit all potential users.

It should further be apparent to those skilled in the art that various changes in form and details of the invention as shown and described may be made. It is intended that such changes be included within the spirit and scope of the claims appended hereto.

Further objects and advantages will become apparent from a consideration of the ensuing description and drawings.

BRIEF DESCRIPTION OF THE SEVERAL VIEWS OF THE DRAWING

A preferred embodiment of the present invention will now be described with reference to the accompanying drawings in which.

DETAILED DESCRIPTION OF THE INVENTION

Figure 1A:
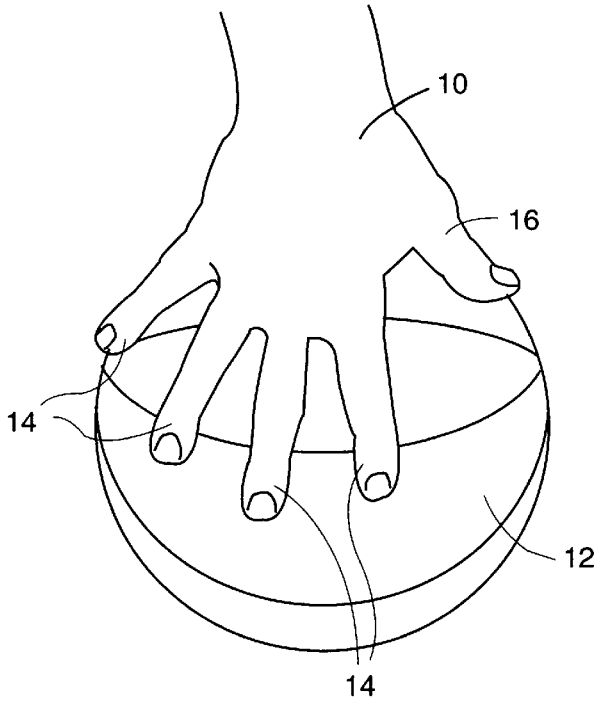
FIG. 1A shows a perspective view of a large hand gripping a regulation size basketball.
Figure 1B:
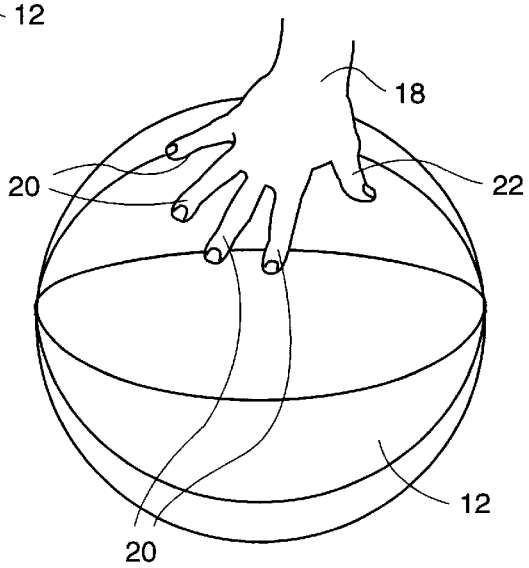
FIG. 1B shows a perspective view of a small hand attempting, but failing, to grip a regulation size basketball.
Figure 1C:
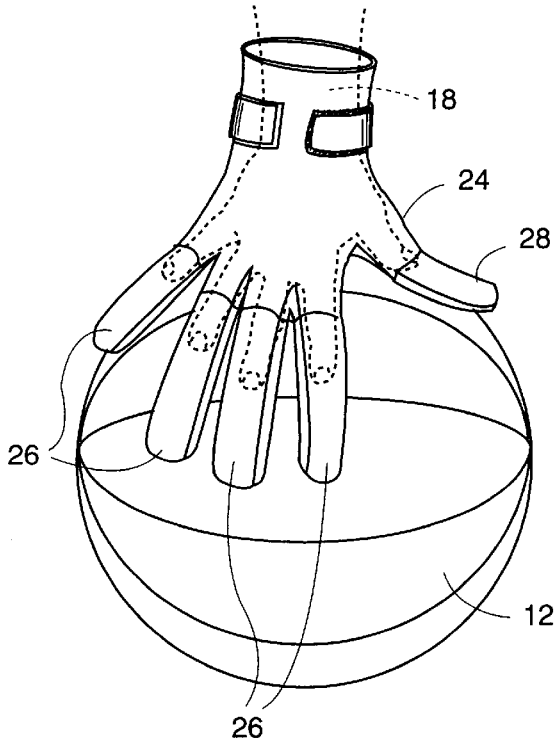
FIG. 1C shows a perspective view of the basketball glove being worn on a small hand and used to grip a regulation size basketball.

Turning now to the drawings, more particularly to FIG. 1A, there is shown a large hand 10 gripping a basketball 12. Note that fingers 14 and thumb 16 expand over a large portion of the surface of basketball 12. In FIG. 1B, a small hand 18 is shown attempting, but failing, to grip basketball 12. Note that fingers 20 and thumb 22 expand over a much smaller portion of the surface of basketball 12 when compared to fingers 14 and thumb 16 shown in FIG. 1A. In FIG. 1C, small hand 18 is shown wearing a basketball glove 24 and gripping basketball 12. Note that finger portions 26 and thumb portion 28 of basketball glove 24 expand over the same large portion of the surface of basketball 12 as fingers 14 and thumb 16 of large hand 10 shown in FIG. 1A. As is more fully explained below, basketball glove 24 gives a player with small hands the same advantages enjoyed by a player with large hands in performing basketball fundamentals such as shooting, dribbling, passing, catching, and rebounding.

FIGS. 2, 3, 4 and 4A show a basketball glove 24 constructed in accordance with the present invention. Basketball glove 24 comprises finger extension portions 32, a thumb extension portion 34, finger stalls 36, a thumb stall 38, a backside 40, a palm side 42, and a wrist portion 44.

Glove 24 has finger extension portions 32 attached to finger stalls 36, and finger spacers 54 affixed around finger stalls 36. Break line 56 separates finger extension portions 32 and backside 40. Break line 56 creates a hinge 57 which allows finger extension portions 32 to move forward and limits retraction which prevents finger extension portions 32 from hyperextending. Finger extension portions 32 and break line 56 provide a combination of flexibility for gripping a basketball and protection for user's hand against impacts encountered when playing basketball. Condensed protective pads for back of user's hand, not shown, may be secured to backside 40 of basketball glove 24 to allow additional protection of hand. Finger spacers 54 prevent finger extension portions 32 from overlapping and position user's fingers in proper ball handling position.

Finger extension portions 32 are made of a resilient polymeric foam material such as sponge rubber, a polyurethane, polystyrene or polyvinylchloride foam, or similar impact absorptive materials. As shown in FIGS. 4, 4A, 5 and 5A finger extension portions 32 extend lengthwise along the top of finger stalls 36 and are attached by cementing, gluing or bonding, such as uniting two monomers to form a polymer bond as is done in the polymerization which creates the resilient polymeric foam material mentioned above.

Stiffening components in the form of bars or rods 37 made of a durable material such as metal or plastic, may be inserted into the centers of finger extension portions 32 to provide additional rigidness. Finger extension portions with protruding planks 33 may be used in addition to or in lieu of stiffening components in the form of bars or rods 37.

Stiffening components in the form of bars or rods 37 are preferably one piece, synthetic plastic material elements formed from a hardenable mixture of filaments or fibers saturated in a resin system. However, stiffening components in the form of bars or rods 37 may be made of any other resilient, flexible material with a suitable toughness to give a useful flexural fatigue life, such as advanced composite thermoplastics, thermosets, polyvinylchloride, styrene blends, engineered plastics, or fiber reinforced plastics. The present invention is not limited to use of these materials, but these materials can be used due to their properties. Other rigid materials may be substituted for these materials if they have similar or superior strength, tear resistance, flexural modulus, and flexibility properties.

Thumb extension portion 34 of basketball glove 24 is connected to thumb stall 38 in a manner analogous to that described above for finger portions. Thumb extension portion 34 extends lengthwise along the top of thumb stall 38 and is attached by cementing, gluing or bonding, such as uniting two monomers to form a polymer bond as mentioned in the polymerization process mentioned above. The preferred impact absorptive material utilized in the construction of thumb extension portion 34 is a resilient polymeric foam material such as sponge rubber, a polyurethane or polychloride foam, or similar impact absorptive materials. A stiffening component in the form of a bar or rod 39, made of a durable material such as metal or plastic, may be inserted into thumb extension portion 34 to provide additional rigidness. Thumb extension portion with a protruding plank, not shown, may be used in addition to or in lieu of stiffening component in the form of a bar or rod 39.

Stiffening component in the form of a bar or rod 39 is preferably a one piece, synthetic plastic material element formed from a hardenable mixture of filaments or fibers saturated in a resin system. However, stiffening component in the form of a bar or rod 39 may be made of any other resilient, flexible material with a suitable toughness to give a useful flexural fatigue life, such as advanced composite thermoplastics, thermosets, polyvinylchloride, styrene blends, engineered plastics, or fiber reinforced plastics.

Wrist portion 44 is made of a stretchable material such as elastic to insure that basketball glove 24 fits user's hand snugly so as not to interfere with the handling of a basketball. A hook and loop fastening element 74 is secured to backside 40 of basketball glove 24. A strap 76 is provided to attach to fastening element 74 so as to prevent basketball glove 24 from slipping while being worn by user. Strap 76 has a mating hook and loop fastening element 78 on its inner surface which is engageable with hook and loop fastening element 74 secured to backside 40 of basketball glove 24. Strap 76 is wrapped around snugly just above wrist portion 44 and prevents basketball glove 24 from moving or slipping while on user's hand. The attachment of strap 76 and mating fastening element 74 on backside 40 of basketball glove 24 can be accomplished by sewing, gluing, or any other means sufficient to withstand the forces incurred. Alternatively, slippage of basketball glove 24 may be prevented by use of a button, not shown; snap, not shown; expandable elastic, not shown; or chord, not shown.

Palm side 42 of basketball glove 24 has a plurality of friction enhancing elements 80. Ventilation openings 82 are placed on palm side to allow cooling air to pass through. Palm side 42 is adapted to encircle the hand without encumbering the wrist. Alternatively, friction enhancing elements 80 on palm side 42 can be arranged in a circular pattern or other designs, not shown, which enhance user's grip.

Figure 2:
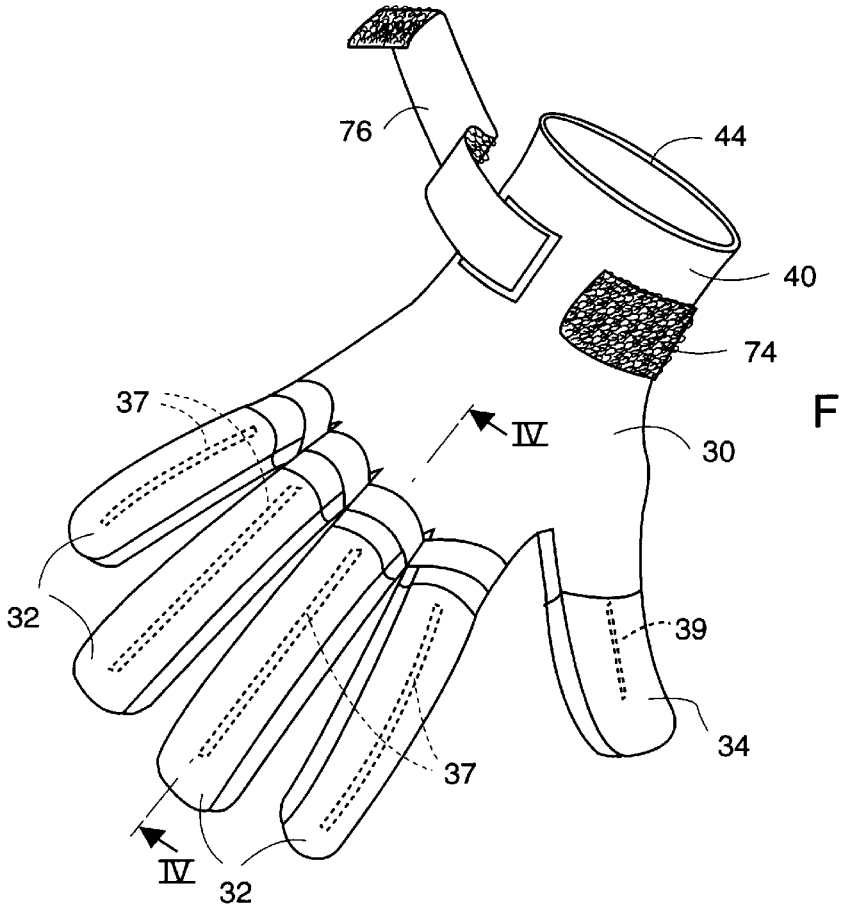
FIG. 2 shows an anterior perspective view of the backside of the basketball glove constructed in accordance with the present invention.
Figure 3:
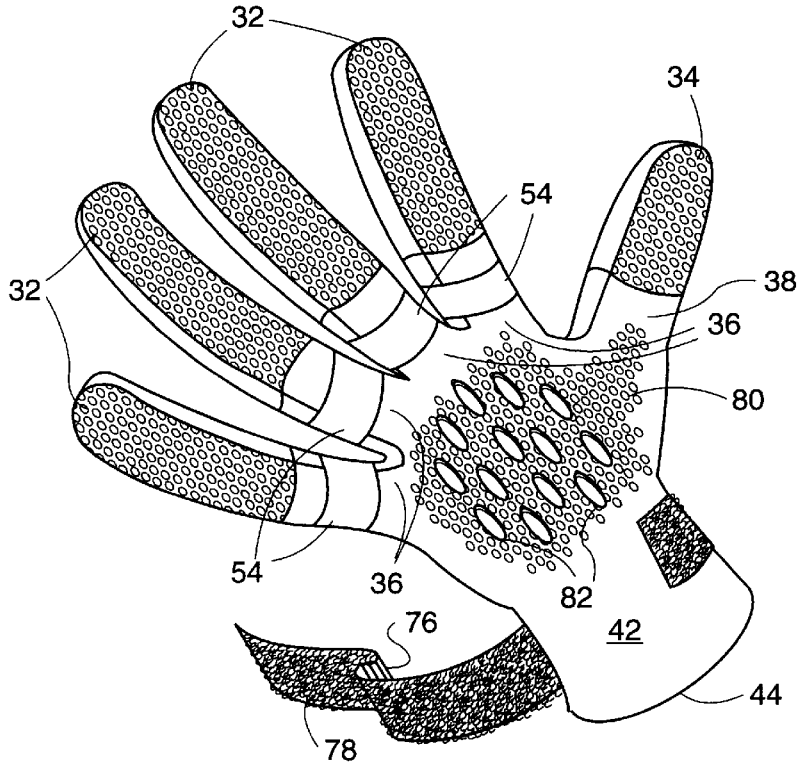
FIG. 3 shows an interior perspective view of the palm side of the basketball glove.
Figure 4:
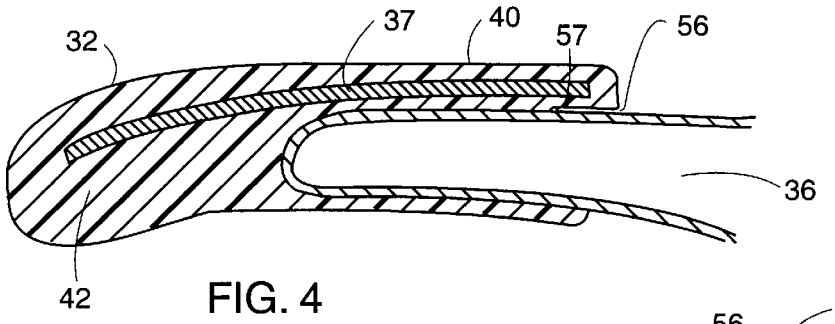
FIG. 4 shows a fragmented section view along section lines IV—IV of FIG. 2, showing the construction of the finger portions.
Figure 4A:
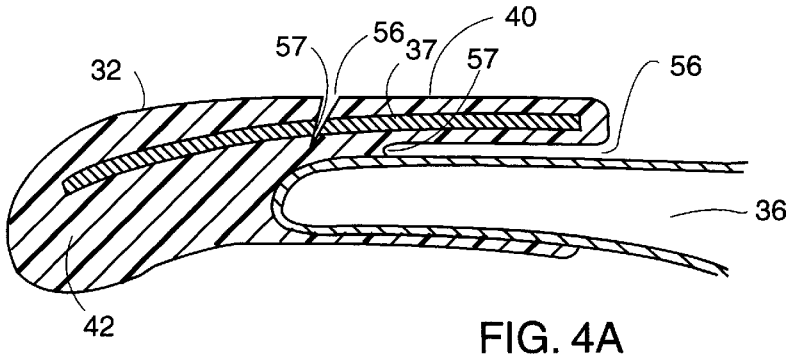
FIG. 4A shows a section view, similar to FIG. 4 but showing an alternative embodiment of the invention.
Figure 5:
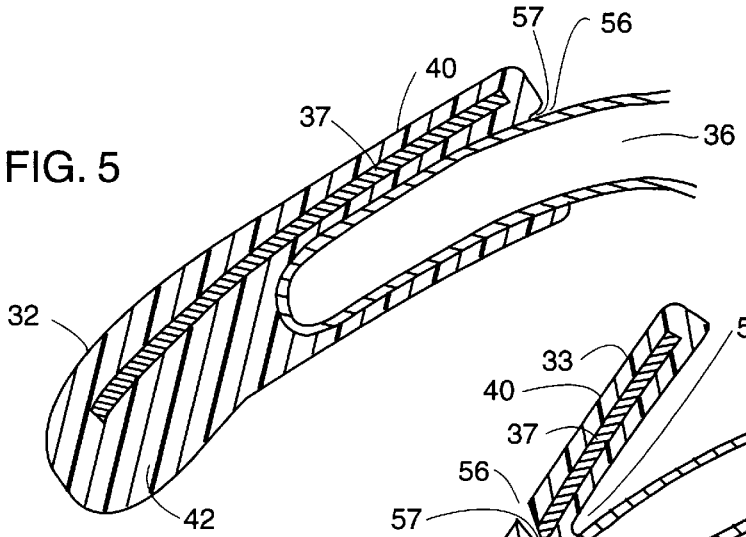
FIG. 5 shows a section view, similar to FIG. 4 but showing the flexibility of the basketball glove in accordance with the present invention.
Figure 5A:
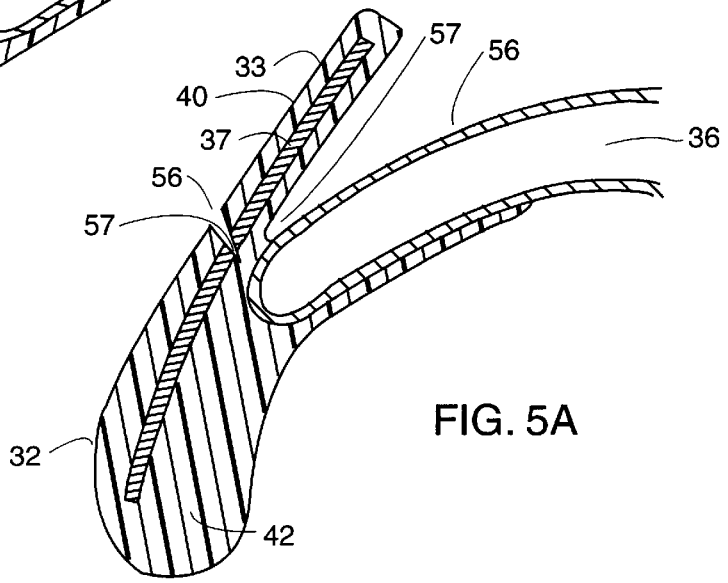
FIG. 5A shows a section view, similar to FIG. 5 but showing an alternative embodiment of the invention.

The manner of using basketball glove of present invention will now be described in greater detail with reference to FIGS. 2 and 3. User should select a glove size which corresponds to the size of his or her hand. User's hand is then fitted into basketball glove 24 with thumb placed into thumb stall 38 and fingers placed into respective finger stalls 36. Strap 76 is made taut and fastened to mating fastening element 74 preventing basketball glove 24 from sliding. Once basketball glove 24 is affixed to hand user moves his or her fingers and thumb to position the respective finger extension portions 32 and thumb extension portion 34 on surface of basketball. The mechanical extension of user's fingers and thumb creates an expanded hand periphery giving the user a larger extremity to grip a basketball. Plurality of friction enhancing elements 80 on palm side 42 of basketball glove 24 resist rotation of basketball and reduce the possibility that basketball will slip from basketball glove's grasp once it is gripped. Snug wrist portion 44 leaves user's wrist unencumbered to allow free movement of wrist for performing basketball fundamentals such as shooting, dribbling, passing, catching, and rebounding.

Use of basketball glove 24 teaches user proper basketball handling mechanics by correcting faulty basketball handling mistakes. Finger extension portions 32 and thumb extension portion 34 arch user's hand while finger spacers 54 keep user's fingers spread apart. The arch of hand coupled with the spread apart position of fingers force user's hand to assume the correct shape for handling a basketball when he or she wears basketball glove 24. The correct shape of hand allows user to quickly and easily place finger extension portions 32 and thumb extension portion 34 at any desired location on surface of basketball. The correct placement of finger extension portions 32 and thumb extension portion 34 on surface of basketball provide user with more agility when dribbling, more precision when passing, and more comfort when catching a basketball. If basketball glove 24 is not allowed to be used in game competition, use of basketball glove 24 during practice will remind user to form his or her hand into the correct basketball handling shape.

Use of basketball glove 24 also teaches user proper fundamentals for shooting a basketball by correcting poor basketball shooting techniques. Finger extension portions 32 maintain user's fingers in an outstretched position, and thumb extension portion 34 maintains user's thumb in an outstretched position. When user shoots a basketball while wearing basketball glove 24 the weight of basketball coupled with the constant outstretched position of fingers and thumb keeps user's elbow close to his or her body and forces user's forearm to remain straight. The consistent position of the elbow close to the body provides an anchor which develops proper arch when shooting a basketball. The straight forearm provides accurate aim and teaches user to shoot basketball toward the basket rather than throw basketball to the basket. Gravity pulls the weight of basketball glove 24 to the ground once basketball is released and forces user to follow through with his or her shot by flicking the wrist. The follow through creates spin and develops proper rotation on basketball. Use of basketball glove 24 over an extended period of time will condition user to keep his or her fingers outstretched, elbow in, and forearm straight when shooting a basketball.

Use of basketball glove 24 also protects user's hand and reduces risk of injury. Finger extension portions 32, and thumb extension portion 34 distribute the impact of energy encountered when a basketball comes in contact with basketball glove 24, thereby reducing the impact felt by user. Stiffening components in the form of bars or rods 37 and 39, and protruding planks 33 prevent fingers and thumb from being hyperextended or jammed into sockets of hand.

An additional use for basketball glove 24 is that of strengthening the muscles of hand, fingers, thumb, wrist, and forearm. Strengthened fingers, thumb, and hand can be facilitated by various exercises which may be performed with basketball glove 24. One may bring finger extension portions 32 together, bend fingers toward thumb extension portion 34 and subsequently release fingers backwards a series of times on a regular basis. This exercises the thumb, fingers, as well as the hand and if done on a regular basis can greatly increase the strength of all three. In addition, the continuous up and down movement of the wrist exerted when shooting, dribbling and passing a basketball, as well as the weight of glove 24 exercises and strengthens both wrist muscles and forearm muscles.

I claim:

1. A method for gripping a basketball by increasing a player's hand peripheral reach, comprising the steps of:

a. lengthening finger portions of a glove by mounting finger extension bodies along finger stalls of said glove;

b. lengthening thumb portion of said glove by mounting a thumb extension body along thumb stall of said glove;

c. wearing said glove on said player's hand by inserting fingers and thumb into the respective stalls; and d. compressing said finger portions and said thumb portion against surface of said basketball;

whereby said basketball will be securely clasped between said finger portions and said thumb portion.

2. An athletic glove for increasing hand peripheral reach comprising: the glove having an interior and exterior being formed of extensible material having palm side, backside, finger and thumb stalls; extension portions permanently attached to the exterior of each of the finger and thumb stalls at ends thereof; each of said extension portions formed of a resilient material surrounding a stiffening component of rigid material.

3. The glove of claim 2 wherein said attaching means comprises uniting two monomers to form a polymeric adhesive.

4. The glove of claim 2 further including ventilation openings placed on said palm side.

5. The glove of claim 2 further including a wrist portion made of extensible material.

6. The glove of claim 2 further including break lines separating said extension portions and said backside.

7. The glove of claim 2 further including flexible finger spacers affixed around said finger and thumb stalls.

8. The glove of claim 4 wherein said ventilation openings are surrounded by friction enhancing elements.

9. The glove of claim 5 wherein said wrist portion contains a hook and loop fastening element.

* * * * *